US009399163B2

(12) United States Patent
Laster

(10) Patent No.: US 9,399,163 B2
(45) Date of Patent: Jul. 26, 2016

(54) ATHLETIC TRAINING ASSEMBLY

(71) Applicant: Ron Laster, Wickliffe, KY (US)

(72) Inventor: Ron Laster, Wickliffe, KY (US)

( * ) Notice: Subject to any disclaimer, the term of this patent is extended or adjusted under 35 U.S.C. 154(b) by 0 days.

(21) Appl. No.: 14/587,868

(22) Filed: Dec. 31, 2014

(65) Prior Publication Data

US 2016/0184685 A1 Jun. 30, 2016

(51) Int. Cl.
*A63B 69/36* (2006.01)

(52) U.S. Cl.
CPC ..... *A63B 69/3641* (2013.01); *A63B 69/3644* (2013.01); *A63B 69/36* (2013.01)

(58) Field of Classification Search
CPC ..... A63B 69/3644
USPC ..... 473/266, 417, 453, 25–260, 261; 482/20–22, 98; 403/168
See application file for complete search history.

(56) References Cited

U.S. PATENT DOCUMENTS 1,854,392 A * 4/1932 Bambrick ..... A63B 69/3644 434/252
3,339,927 A * 9/1967 Nunn ..... A63B 69/3644 248/455
3,489,416 A * 1/1970 Mark ..... A63B 69/3644 473/229
3,711,103 A * 1/1973 Seltzer ..... A63B 69/3644 473/229
4,071,251 A 1/1978 Beckish
5,423,548 A 6/1995 Bricker
D375,774 S 11/1996 Harrold
5,895,327 A 4/1999 Francisco
7,670,233 B2 3/2010 Jones
8,974,316 B2 * 3/2015 Sery ..... A63B 69/365 473/229
2011/0275447 A1 * 11/2011 Jasinski ..... A63B 69/0057 473/271
2014/0128174 A1 * 5/2014 Hardaway ..... A63B 69/3641 473/257

* cited by examiner

*Primary Examiner* — Gene Kim
*Assistant Examiner* — Rayshun Peng

(57) ABSTRACT

A athletic training assembly includes a base that may be positioned on a support surface. A pair of guide rods is each movably coupled to the base. Each of the pair of guide rods is curved between a first end and a second end of the pair of guide rods. The first end and the second end of each of the pair of guide rods is coupled together. The pair of guide rods forms a crescent shape. A user slidably engages an athletic implement to each of the pair of guide rods. The athletic implement travels upwardly and downwardly between the first and second ends of the pair of guide rods when the user swings the athletic implement. The pair of guide rods retains the athletic implement on a correct trajectory. The user is trained in swinging the athletic implement in the correct trajectory.

11 Claims, 5 Drawing Sheets

ATHLETIC TRAINING ASSEMBLY

BACKGROUND OF THE DISCLOSURE

1. Field of the Disclosure

The disclosure relates to training devices and more particularly pertains to a new training device for assisting a user in practicing a golf swing.

2. Summary of the Disclosure

An embodiment of the disclosure meets the needs presented above by generally comprising a base that may be positioned on a support surface. A pair of guide rods is each movably coupled to the base. Each of the pair of guide rods has a first end and a second end. Each of the pair of guide rods is curved between the first and second ends of the pair of guide rods. The first end and the second end of each of the pair of guide rods is coupled together such that the pair of guide rods forms a crescent shape. A user slidably engages an athletic implement to each of the pair of guide rods. The athletic implement travels upwardly and downwardly between the first and second ends of the pair of guide rods when the user swings the athletic implement. The pair of guide rods retains the athletic implement on a correct trajectory when the user swings the athletic implement. The user is trained in swinging the athletic implement in the correct trajectory.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
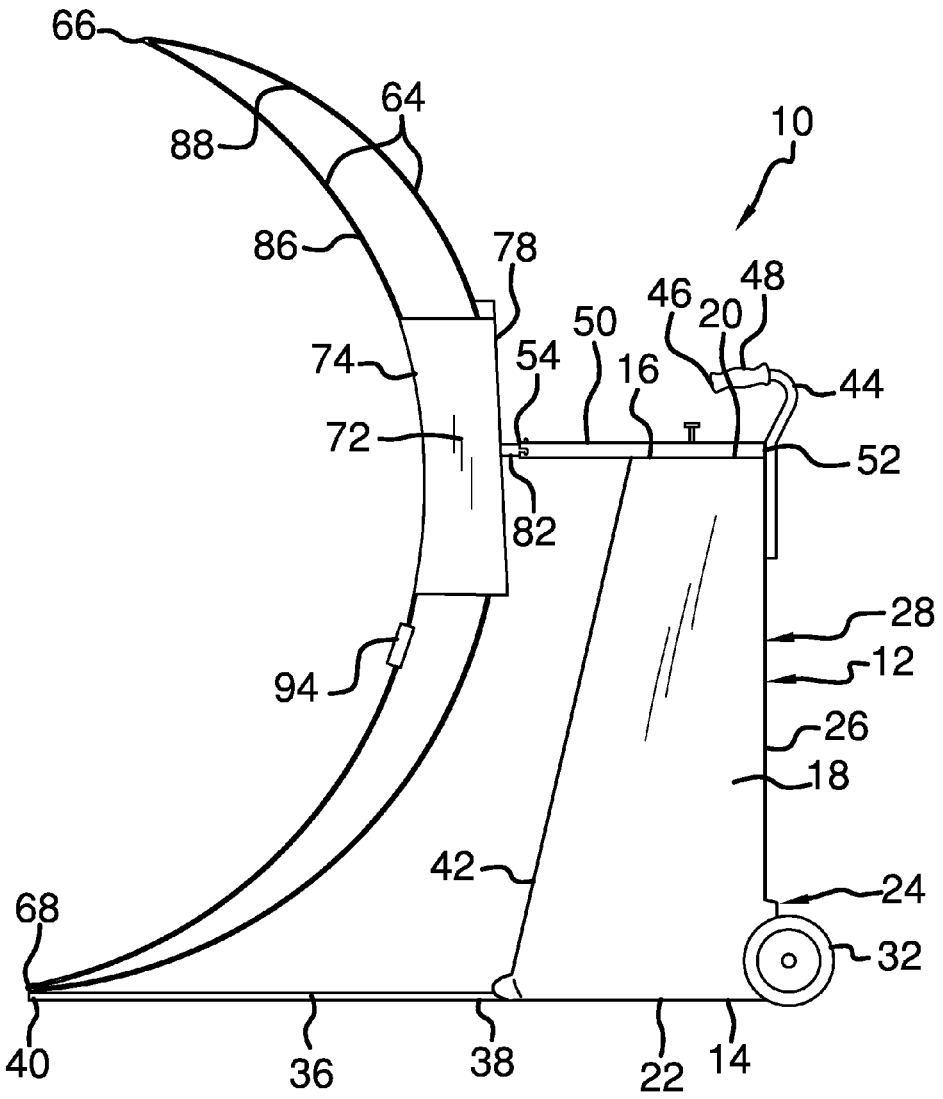
FIG. 1 is a left side view of a athletic training assembly according to an embodiment of the disclosure.
Figure 2:
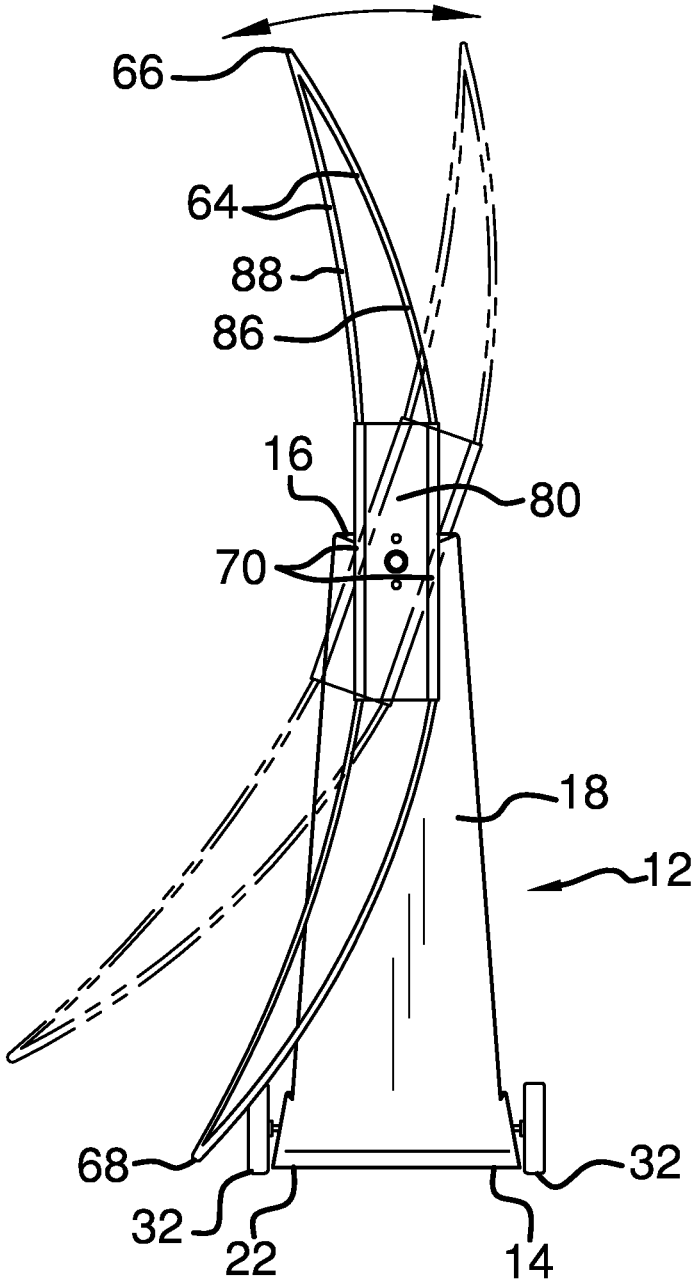
FIG. 2 is a front view of an embodiment of the disclosure.
Figure 3:
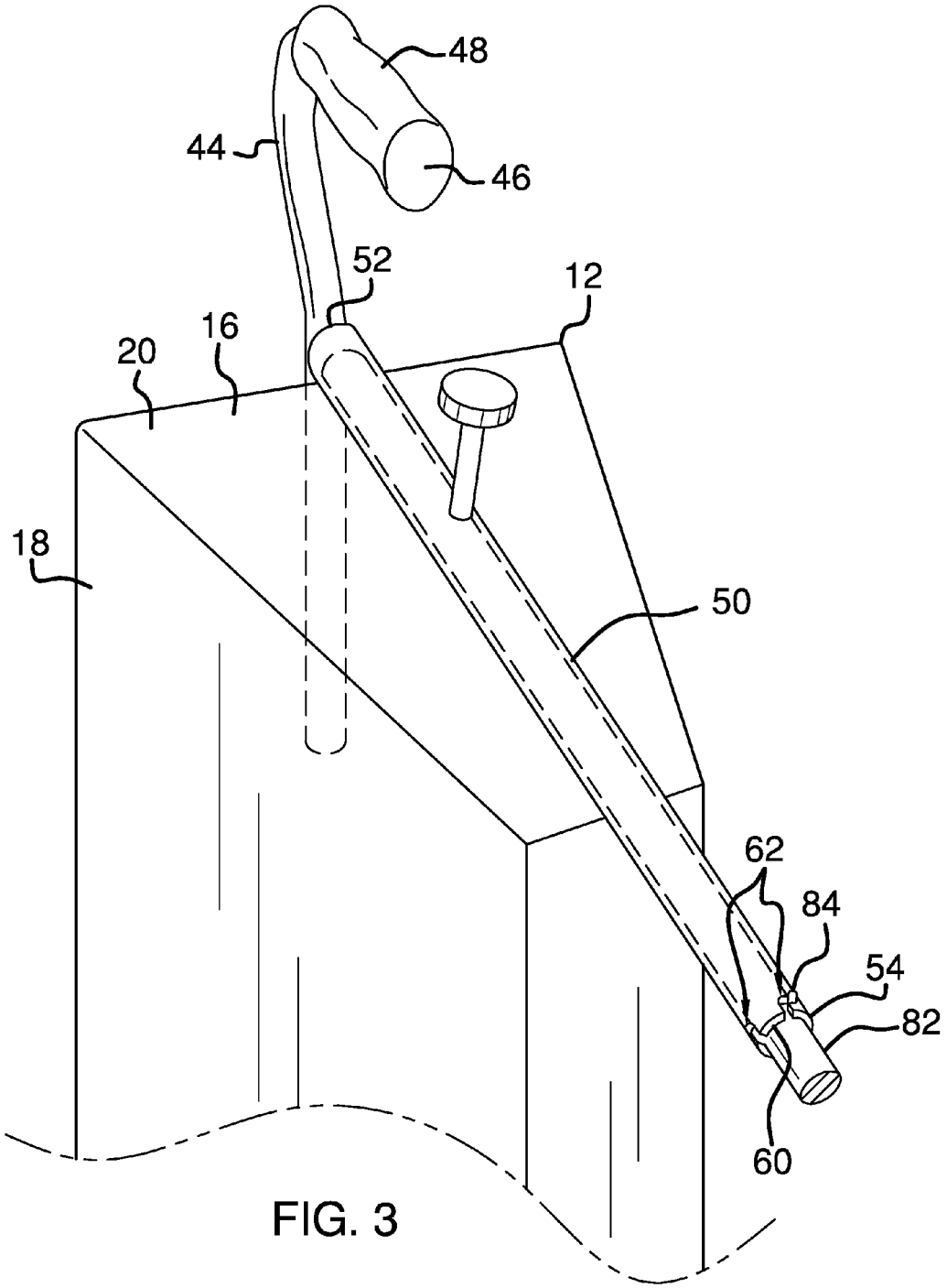
FIG. 3 is a top perspective view of an embodiment of the disclosure.
Figure 4:
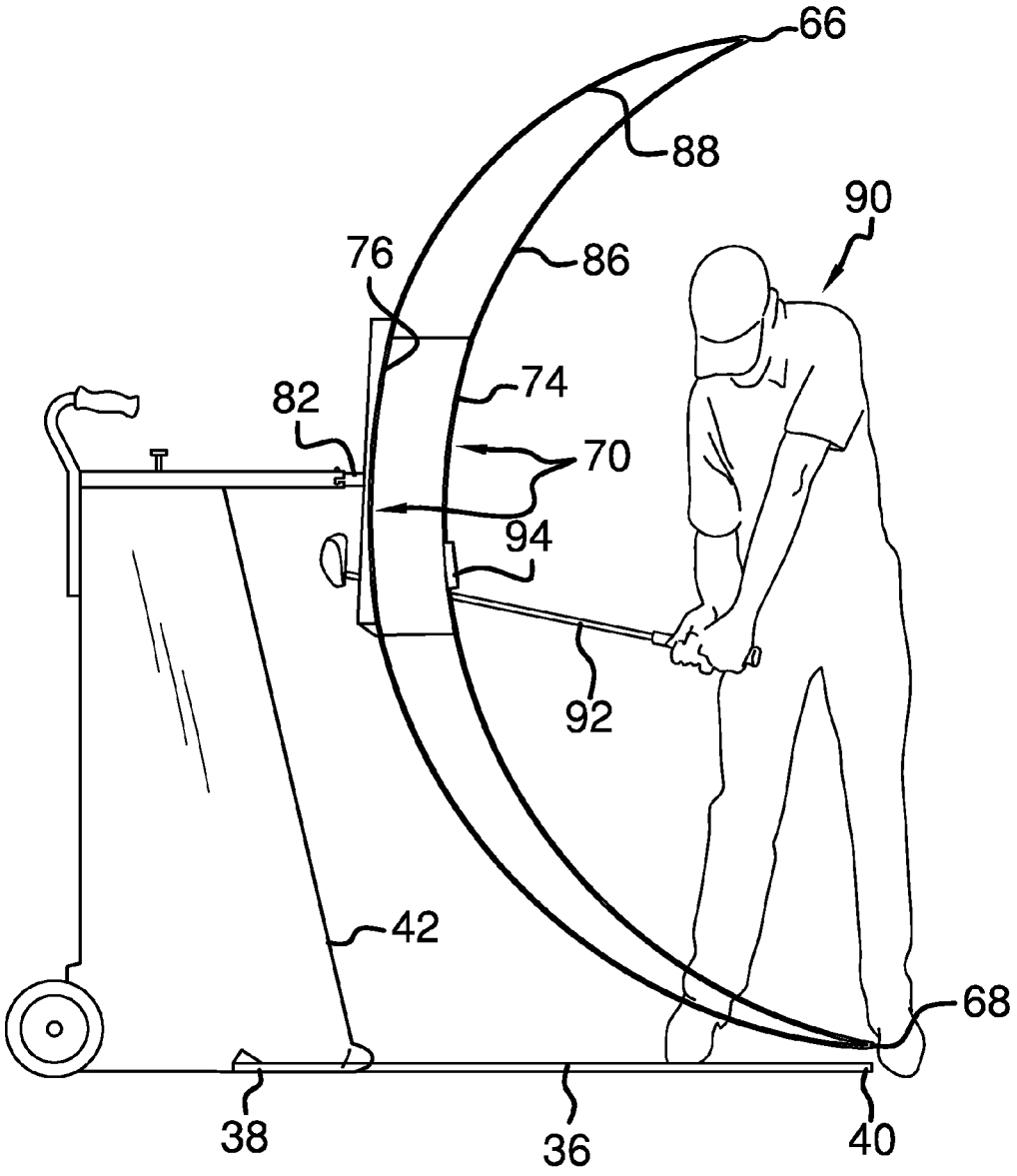
FIG. 4 is an in-use view of an embodiment of the disclosure.
Figure 5:
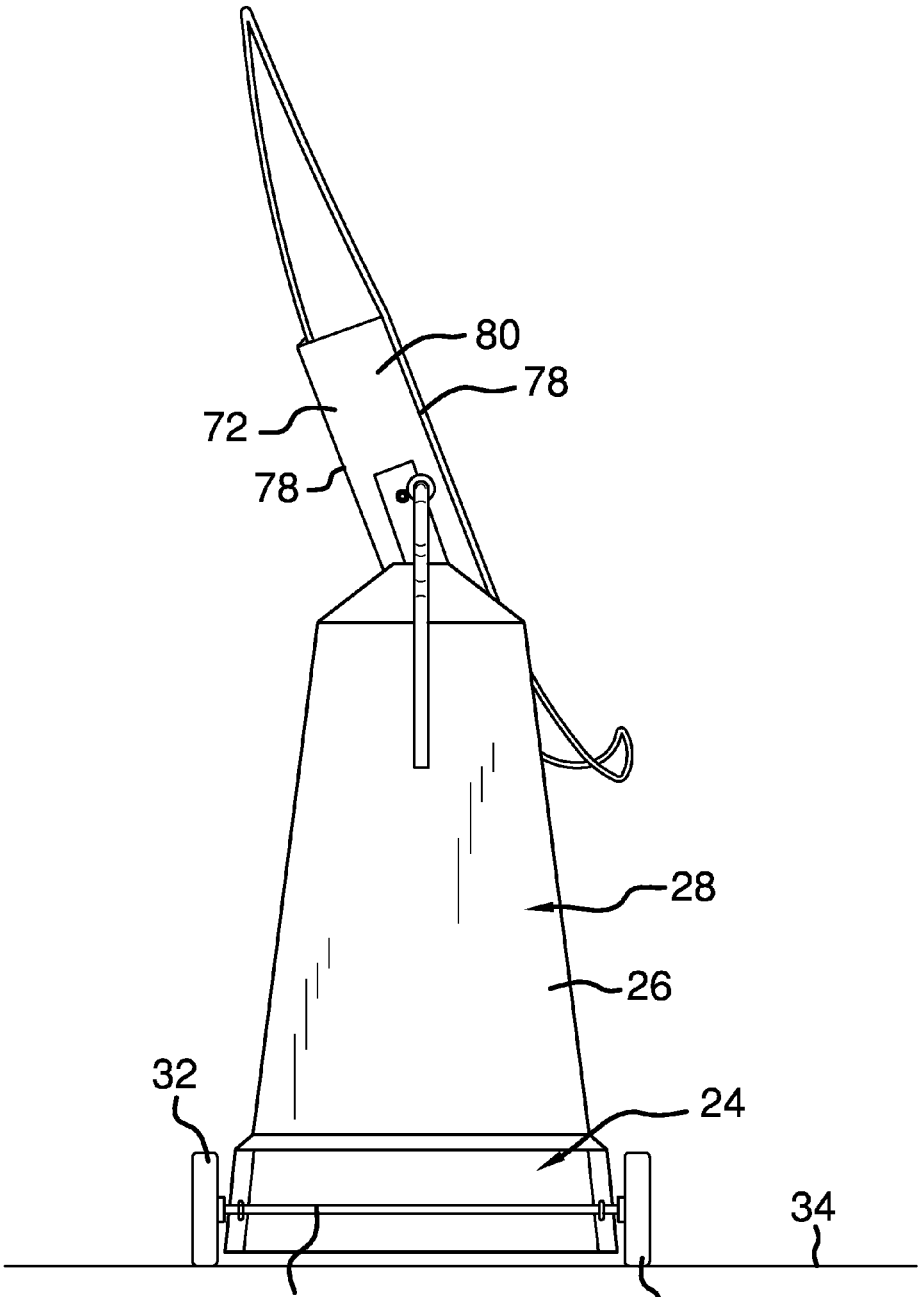
FIG. 5 is a back view of an embodiment of the disclosure.

With reference now to the drawings, and in particular to FIGS. 1 through 5 thereof, a new training device embodying the principles and concepts of an embodiment of the disclosure and generally designated by the reference numeral 10 will be described.

As best illustrated in FIGS. 1 through 5, the athletic training assembly 10 generally comprises a base 12 that has a bottom end 14 and a top end 16. The base 12 is elongated between the bottom 14 and top 16 ends. The base 12 has an outer wall 18 extending between the bottom 14 and top 16 ends of the base 12. A top side 20 of the outer wall 18 of the base 12 may have a width that is less than a width of a bottom side 22 of the outer wall 18 of the base 12. The base 12 may have a trapezoidal shape.

A lower portion 24 of a back side 26 of the outer wall 18 of the base 12 extends rearwardly from an upper portion 28 of the back side 26 of the outer wall 18 of the base 12. An axle 30 is coupled to the lower portion 24 of the back side 26 of the outer wall 18 of the base 12. The axle 30 extends laterally across the base 12. A pair of wheels 32 is rotatably coupled each of an associated end of the axle 30. The pair of wheels 32 abut a support surface 34 so the base 12 is movable along the support surface 34. The support surface 34 may be ground.

An alignment rod 36 is provided. The alignment rod 36 has a coupled end 38 and a free end 40. The alignment rod 36 is elongated. Moreover, the coupled end 38 of the alignment rod 36 is coupled to a front side 42 of the outer wall 18 of the base 12 proximate the bottom side 22 of the base 12. The alignment rod 36 extends forwardly away from the base 12 proximate the support surface 34.

A handle 44 is coupled to the back side 26 of the outer wall 18 of the base 12 such that the handle 44 extends upwardly above the top side 20 of the outer wall 18 of the base 12. The handle 44 is bent so a gripping end 46 of the handle 44 is spaced upwardly from the top side 20 of the outer wall 18 of the base 12. The gripping end 46 of the handle 44 is directed toward the front side 42 of the outer wall 18 of the base 12. A grip 48 is coupled to the handle 44 proximate the gripping end 46 of the handle 44. The grip 48 may be gripped so the base 12 may be maneuvered on the support surface 34.

A coupling shaft 50 is provided. The coupling shaft 50 has a primary end 52 and a secondary end 54. The secondary end 54 of the coupling shaft 50 is coupled to the handle 44. The coupling shaft 50 extends forwardly from the top side 20 of the outer wall 18 of the base 12.

The secondary end 54 of the coupling shaft 50 is open. A front edge 60 of the secondary end 54 of the coupling shaft 50 has a plurality of grooves 62 extending rearwardly thereon. The plurality of grooves 62 are evenly spaced apart. Additionally, the plurality of grooves 62 are distributed around an entire circumference of the coupling shaft 50.

A pair of guide rods 64 each has a first end 66 and a second end 68. Each of the pair of guide rods 64 is curved between the first 66 and second 68 ends of the pair of guide rods 64. The first end 66 and the second end 68 of each of the pair of guide rods 64 is coupled together. The pair of guide rods 64 forms a crescent shape. Moreover, the pair of guide rods 64 is spaced apart proximate a center 70 of each of the pair of guide rods 64. The pair of guide rods 64 further forms a spherical lune.

A retaining plate 72 is provided. The retaining plate 72 has a first lateral edge 74 and a second lateral edge 76. The retaining plate 72 has a pair of longitudinal bends 78 so each of the first 74 and second 76 lateral edges of the retaining plate 72 are directed forwardly from a central portion 80 of the retaining plate 72. Additionally, the first lateral edge 74 of the retaining plate 72 is spaced further away from the central portion 80 of the retaining plate 72 than the second lateral edge 76 of the retaining plate 72.

A rotation rod 82 is coupled to and extends rearwardly away from the central portion 80 of the retaining plate 72. A pin 84 is coupled to and extends laterally away from the rotation rod 82. The pin 84 is positioned proximate the retaining plate 72. The rotation rod 82 is inserted into the secondary end 54 of the coupling shaft 50. The pin 84 on the rotation rod 82 engages a selected one of the plurality of grooves 62 on the coupling shaft 50.

The first 74 and second 76 lateral edges of the retaining plate 72 are directed forwardly from the coupling shaft 50.

Each of the first 74 and second 76 lateral edges of the retaining plate 72 engages an associated one of a first one 86 and a second one 88 of the pair of guide rods 64 proximate the center 70 of the first 86 and second 88 guide rods. The pair of guide rods 64 are retained on the retaining plate 72. The retaining plate 72 is selectively orientated so the pair of guide rods 64 are positioned at a selected angle with respect to the support surface 34.

The curve of the second guide rod 86 spaces the center 70 of the second guide rod 86 laterally away from each of the first 66 and second 68 ends of the second guide rod 86. The center 70 of the second guide rod 86 may be spaced a distance between 7 cm and 10 cm from the first end 66 of the second guide rod 86. The center 70 of the second guide rod 86 may be spaced a distance between 33 cm and 36 cm from the second end 68 of the second guide rod 86.

A user 90 slidably engages an athletic implement 92 to each of the pair of guide rods 64. The athletic implement 92 travels upwardly and downwardly between the first 66 and second 68 ends of the second guide rod 86 when the user 90 swings the athletic implement 92. The athletic implement 92 may be a golf club of any conventional design. A stop 94 is removably coupled to a selected one of the first 86 and second 88 guide rods.

In use, the athletic implement 92 slidably engages the first guide rod 88 on an upswing of the athletic implement 92. The stop 94 is positionable on the first guide rod 88 so the athletic implement 92 abuts the stop 94 at a selected point of the upswing of the athletic implement 92. The stop 94 trains the user 90 in a correct partial upswing.

After the upswing is complete, the athletic implement 92 slidably engages the second guide rod 86 on a downswing of the athletic implement 92. The stop 94 is positionable on the second guide rod 86 so the athletic implement 92 abuts the stop 94 at a selected point of the downswing of the athletic implement 92. The stop 94 trains the user in a correct partial downswing. The first 86 and second 88 guide rods retain the athletic implement 92 on a correct swing path when the user 90 swings the athletic implement 92. The user 90 is trained in swinging the athletic implement 92 in the correct swing path.

The pin 84 on the rotation rod 82 is positioned in a selected one of the plurality of grooves 62 so the pair of guide rods 64 are positioned at the selected angle with respect to the athletic implement 92. The pair of guide rods 64 are positioned at the selected angle to train the user 90 to swing a variety of differing types of athletic implements 92. The user 90 stands proximate the free end 40 of the alignment rod 36 when the user 90 practices swinging the athletic implement 92. The alignment rod 36 properly aligns the user 90 with the pair of guide rods 64.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An athletic training assembly configured to assist a user in practicing a golf swing, said assembly comprising:

a base configured to be positioned on a support surface;

a pair of guide rods movably coupled to said base, each of said pair of guide rods having a first end and a second end, each of said pair of guide rods being curved between said first and second ends of said pair of guide rods;

said first end and said second end of each of said pair of guide rods being coupled together such that said pair of guide rods forms a crescent shape; and the user slidably engaging an athletic implement to each of said pair of guide rods such that the athletic implement travels upwardly and downwardly between said first and second ends of said pair of guide rods when the user swings the athletic implement, said pair of guide rods retaining the athletic implement on a correct trajectory when the user swings the athletic implement such that the user is trained in swinging the athletic implement in the correct trajectory; and a retaining plate rotatably coupled to a secondary end of a coupling shaft, each of a first lateral edge and a second lateral edge of said retaining plate engaging an associated one of a first one and a second one of said pair of guide rods proximate a center of said first guide rod such that said pair of guide rods are retained on said retaining plate, said retaining plate being selectively orientated such that said pair of guide rods are positioned at a selected angle with respect to the support surface.

2. The assembly according to claim 1, further comprising said base having a bottom end and a top end, said base being elongated between said top and bottom ends.

3. The assembly according to claim 1, further comprising an alignment rod having a coupled end and a free end, said alignment rod being elongated.

4. The assembly according to claim 1, further comprising a coupled end of an alignment rod being coupled to said base proximate a bottom end of said base such that said alignment rod extends forwardly away from said base proximate the support surface.

5. The assembly according to claim 1, further comprising a handle coupled to a back side of an outer wall of said base such that said handle extends upwardly above a top side of said outer wall of said base.

6. The assembly according to claim 1, further comprising a coupling shaft having a primary end and a secondary end.

7. The assembly according to claim 1, further comprising a secondary end of a coupling shaft being coupled to a handle such that said coupling shaft extends forwardly from a top side of an outer wall of said base.

8. The assembly according to claim 1, further comprising said pair of guide rods being spaced apart proximate a center of each of said pair of guide rods such that said pair of guide rods forms a spherical lune.

9. The assembly according to claim 1, further comprising the athletic implement slidably engaging a first one of the pair of guide rods on an upswing of the athletic implement, the athletic implement slidably engaging a second one of said pair of guide rods on a downswing of the athletic implement.

10. The assembly according to claim 1, further comprising the user standing proximate a free end of an alignment rod when the user practices swinging the athletic implement such that the user is properly aligned with said pair of guide rods.

11. An athletic training assembly configured to assist a user in practicing a golf swing, said assembly comprising:

a base having a bottom end and a top end, said base being elongated between said top and bottom ends, said base being configured to be positioned on a support surface;

an alignment rod having a coupled end and a free end, said alignment rod being elongated, said coupled end of said alignment rod being coupled to said base proximate said bottom end of said base such that said alignment rod extends forwardly away from said base proximate the support surface;

a handle coupled to a back side of an outer wall of said base such that said handle extends upwardly above a top side of said outer wall of said base;

a coupling shaft having a primary end and a secondary end, said secondary end of said coupling shaft being coupled to said handle such that said coupling shaft extends forwardly from said top side of said outer wall of said base;

a pair of guide rods movably coupled to said base, each of said pair of guide rods having a first end and a second end, each of said pair of guide rods being curved between said first and second ends of said pair of guide rods;

said first end and said second end of each of said pair of guide rods being coupled together such that said pair of guide rods forms a crescent shape, said pair of guide rods being spaced apart proximate a center of each of said pair of guide rods such that said pair of guide rods forms a spherical lune;

a retaining plate rotatably coupled to said secondary end of said coupling shaft, each of a first lateral edge and a second lateral edge of said retaining plate engaging an associated one of a first one and a second one of said pair of guide rods proximate a center of said first guide rod such that said pair of guide rods are retained on said retaining plate;

said retaining plate being selectively orientated such that said pair of guide rods are positioned at a selected angle with respect to the support surface;

the user slidably engaging an athletic implement to each of said pair of guide rods such that the athletic implement travels upwardly and downwardly between said first and second ends of said second guide rod when the user swings the athletic implement;

the athletic implement slidably engaging said first guide rods on an upswing of the athletic implement, the athletic implement slidably engaging said second guide rod on a downswing of the athletic implement, said first and second guide rods retaining the athletic implement on a correct trajectory when the user swings the athletic implement such that the user is trained in swinging the athletic implement in the correct trajectory; and the user standing proximate said free end of said alignment rod when the user practices swinging the athletic implement such that the user is properly aligned with said pair of guide rods.

* * * * *